US006514101B1

(12) United States Patent
Miura

(10) Patent No.: US 6,514,101 B1
(45) Date of Patent: Feb. 4, 2003

(54) ELECTRICAL CONNECTOR FOR FLEXIBLE PRINTED BOARD

(75) Inventor: Kazuto Miura, Kawasaki (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/869,163

(22) PCT Filed: Oct. 24, 2000

(86) PCT No.: PCT/JP00/07406

§ 371 (c)(1),
(2), (4) Date: Jun. 25, 2001

(87) PCT Pub. No.: WO01/31754

PCT Pub. Date: May 3, 2001

(30) Foreign Application Priority Data

Oct. 26, 1999 (JP) ..... 11/304515

(51) Int. Cl.[7] ..... H01R 12/24
(52) U.S. Cl. ..... 439/495; 439/267
(58) Field of Search ..... 439/495, 260, 439/261, 496, 267

(56) References Cited

U.S. PATENT DOCUMENTS 5,785,549 A * 7/1998 Takayasu ..... 439/495
5,842,883 A * 12/1998 Igarashi et al. ..... 439/260
6,116,947 A * 9/2000 Takayasu ..... 439/260
6,206,723 B1 * 3/2001 Kunishi ..... 439/495
6,224,418 B1 * 5/2001 Miura et al. ..... 439/260

FOREIGN PATENT DOCUMENTS

| | | |
|---|---|---|
| JP | 01-315976 | 12/1989 |
| JP | 6-77186 | 10/1994 |
| JP | 09-185977 | 7/1997 |
| JP | 09-283240 | 10/1997 |

* cited by examiner

*Primary Examiner*—Tulsidas Patel
*Assistant Examiner*—Hae Moon Hyeon
(74) *Attorney, Agent, or Firm*—Rader, Fishman & Grauer PLLC

(57) ABSTRACT

An electrical connector for flexible printed board (1) has a housing (4) with an opening, and a cover (7) being rotatable about a predetermined pivotal axis for opening or closing the opening. A resilient piece (35) of a fork-shaped contact (23) has a first and a second branches (39, 41) branched from a free end (38) thereof. The second branch (41) includes a contact point coming into contact with a flexible printed board (2) inserted in an insertion space (3). One edge of the cover (7) is provided with a regulating portion (55) interposed between the first and second branches (39, 41). The regulating portion (55) restricts bidirectional displacements of the free end (38) of the resilient piece (35) within a predetermined range.

12 Claims, 9 Drawing Sheets

ELECTRICAL CONNECTOR FOR FLEXIBLE PRINTED BOARD

TECHNICAL FIELD

The present invention relates to an electrical connector for flexible printed board called FPC (Flexible Printed Circuit).

BACKGROUND ARTS

There has been provided a technique for directly connecting a circuit on a printed circuit board with a contact of a connector. Conventionally, the connector of this type includes a synthetic-resin housing having an opening adapted to open upward, a plurality of fork-shaped contacts arranged to face into the opening, and a synthetic-resin cover which is pivotally movable to open/close the opening of the housing. The fork-shaped contact has a fixing piece and a resilient piece vertically opposed each other.

The connector of this type provides a wide insertion space for FPC as the flexible printed board, for example, when the cover is opened for insertion or removal of the FPC. This contributes an unconfined state of the FPC such that the FPC may be inserted in place without using an inserting force or pulled out without using a pulling force. Thus, the FPC is prevented from being damaged during insertion or removal thereof.

As the connector allowing the insertion or removal of the FPC under unconfined conditions, there have been provided a variety of connectors of a lower contact point type. In the connector of lower contact point, a contact point is provided only at the resilient piece on the lower side. One edge of the cover in closed position is clamped between the FPC resting on the resilient piece and the fixing piece on the upper side so that the FPC is pressed against the resilient piece by means of the clamped edge of the cover.

On the other hand, there is a demand for a connector of an upper contact point type which features an increased freedom with respect to the connection with the FPC and which provides the contact point only at the resilient piece disposed on the upper side.

The following publication has been published by the Japanese Patent Office pertaining a type of connector adapted for connection of stripped conductor ends of a multiple conductor flat cable via the upper and lower contact points.

Country: Japan
Publication Number: 1(1989)-315976 (unexamined)
Published Date: Dec. 20, 1989.

The connector of the above official gazette has a lever arm extended from a distal end of the resilient piece to place above one edge of the cover in closed position. When the cover is opened, the edge of the cover pushes up the lever arm to expand a gap between the two contact points, thereby facilitating the insertion or removal of FPC. Additionally, the lever arm applies a resilient reaction force to the one edge of the cover in open position, thereby maintaining the cover in open position.

In the connector of the above official gazette, however, an upward displacement of the resilient piece is not restricted. Hence, the resilient piece is subjected to plastic deformation when pushed up by some external force. As a result, the resilient piece is incapable of providing a sufficient contact pressure on the FPC.

In view of the foregoing, the present invention has been accomplished and has an object to provide an upper contact point type connector for flexible printed board which ensures a sufficient contact pressure by preventing an excessive deformation of the contact.

DISCLOSURE OF THE INVENTION

For achieving the above object, an electrical connector for flexible printed board according to a preferred embodiment of the invention comprises: a synthetic-resin housing having an opening; a plurality of fork-shaped contacts being arranged to face into the opening, each of the contact having a resilient piece and a fixing piece in opposed relation; an insertion space for flexible printed board defined between the resilient piece and the fixing piece; and a synthetic-resin cover being rotatable around a predetermined pivotal axis to open or close the opening. The plural fork-shaped contacts include a fork-shaped contact including a first and a second branches branched from a free end of the resilient piece. The second branch adjoins the insertion space. The second branch includes a contact point pressed into contact with a flexible printed board inserted in the insertion space. One edge of the cover includes a regulating portion interposed between the first and the second branches for bidirectionally restricting a range of displacement of the free end of the resilient piece.

According to the embodiment hereof, the range of displacement of the free end of the resilient piece can be bidirectionally restricted by the regulating portion disposed at the one edge of the cover sandwiched between the first and the second branches. Therefore, an excessive deformation of the contact may be prevented. As a result, the so-called connector of upper contact point type can ensure a sufficient contact pressure on the flexible printed board at all times. Further, damage on the contact or the flexible printed board is prevented, the damage resulting from the excessive deformation of the contact.

It is particularly preferred that the regulating portion includes a cam surface for pushing the first branch into displacement thereby expanding the insertion space in conjunction with the opening of the cover. In this case, a wide insertion space for flexible printed board is provided when the cover is opened.

It is further preferred that the cam surface moves away from the first branch in conjunction with the closing of the cover. This eliminates the displacement of the first branch caused by the cam surface when the cover is closed. Therefore, the resilience of the resilient piece may be utilized to provide a sufficient contact pressure on the flexible printed board.

BRIEF DESCRIPTION OF THE DRAWINGS

FIG. 5A is a sectional view taken on the line V—V in FIG. 2 whereas

BEST MODE FOR CARRYING OUT THE INVENTION

A preferred embodiment of the invention will be described with reference to the accompanying drawings.

Figure 1:
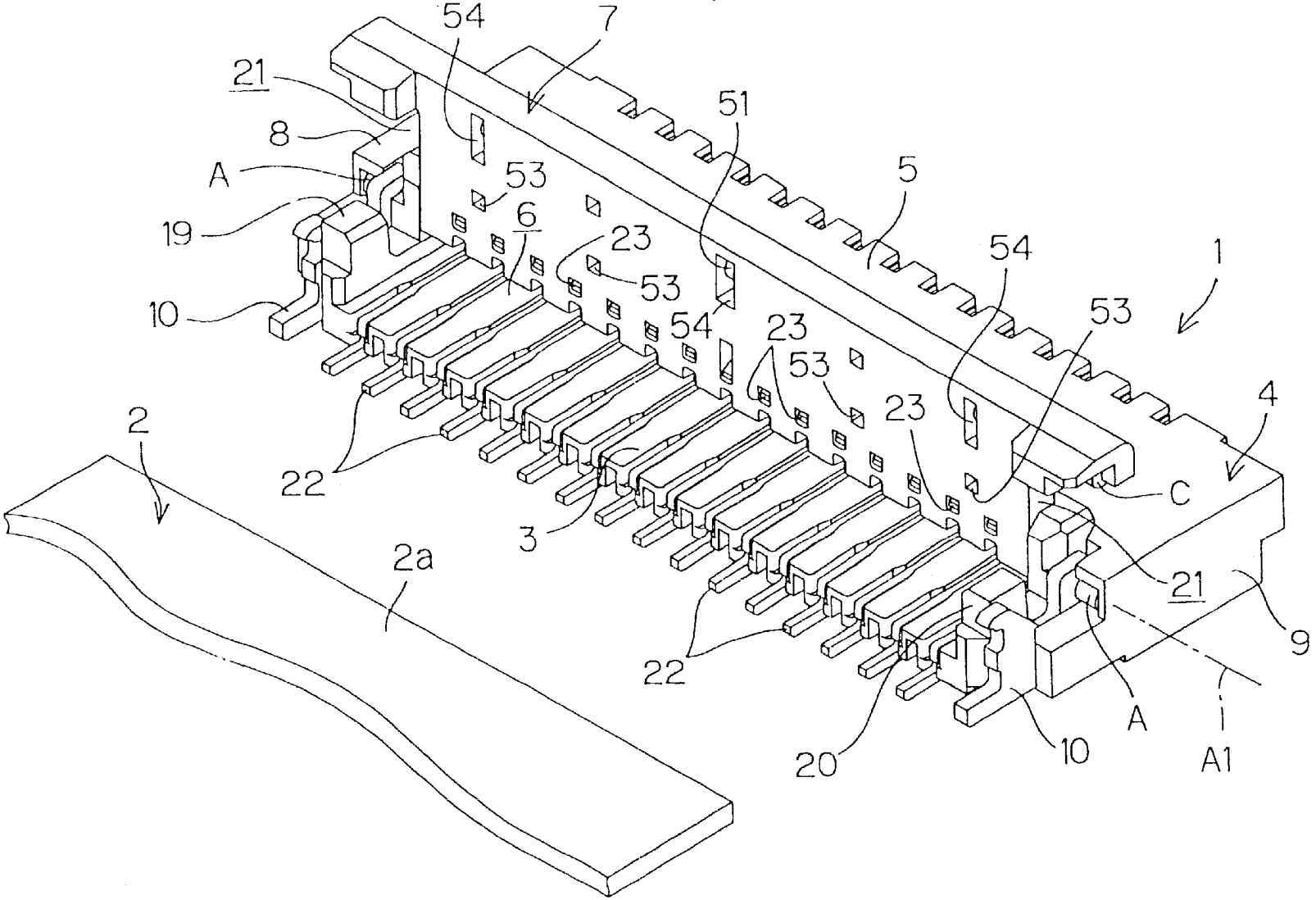
FIG. 1 is a disassembled perspective view showing a connector for flexible printed board according to one embodiment of the invention and an FPC as a flexible printed circuit board.
Figure 2:
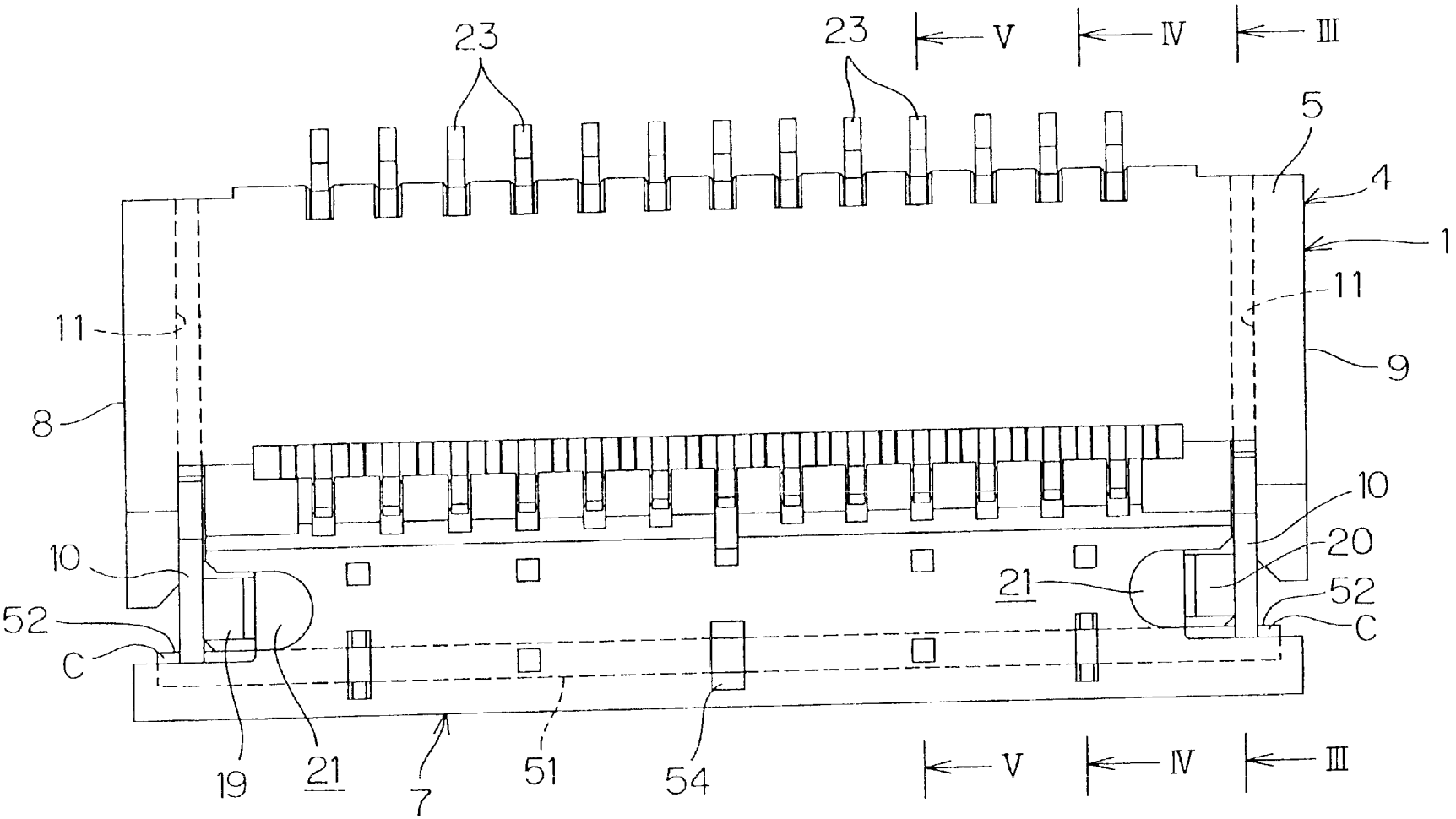
FIG. 2 is a partially cut-away plan view showing the connector with its cover closed.

Referring to FIGS. 1 and 2, a connector 1 for flexible printed board (hereinafter, simply referred to as "connector 1") comprises a synthetic-resin housing 4 defining an insertion space 3 in which a flexible printed circuit board 2 (hereinafter, simply referred to as "FPC 2") is detachably inserted. A front half portion of the housing 4 upwardly opens via an opening 6 of a top plate 5 of the housing 4 and is provided with a cover 7, a molded article of synthetic resin, which is pivotally movable about a pivotal axis A1 to open or close the opening 6.

Figure 8:
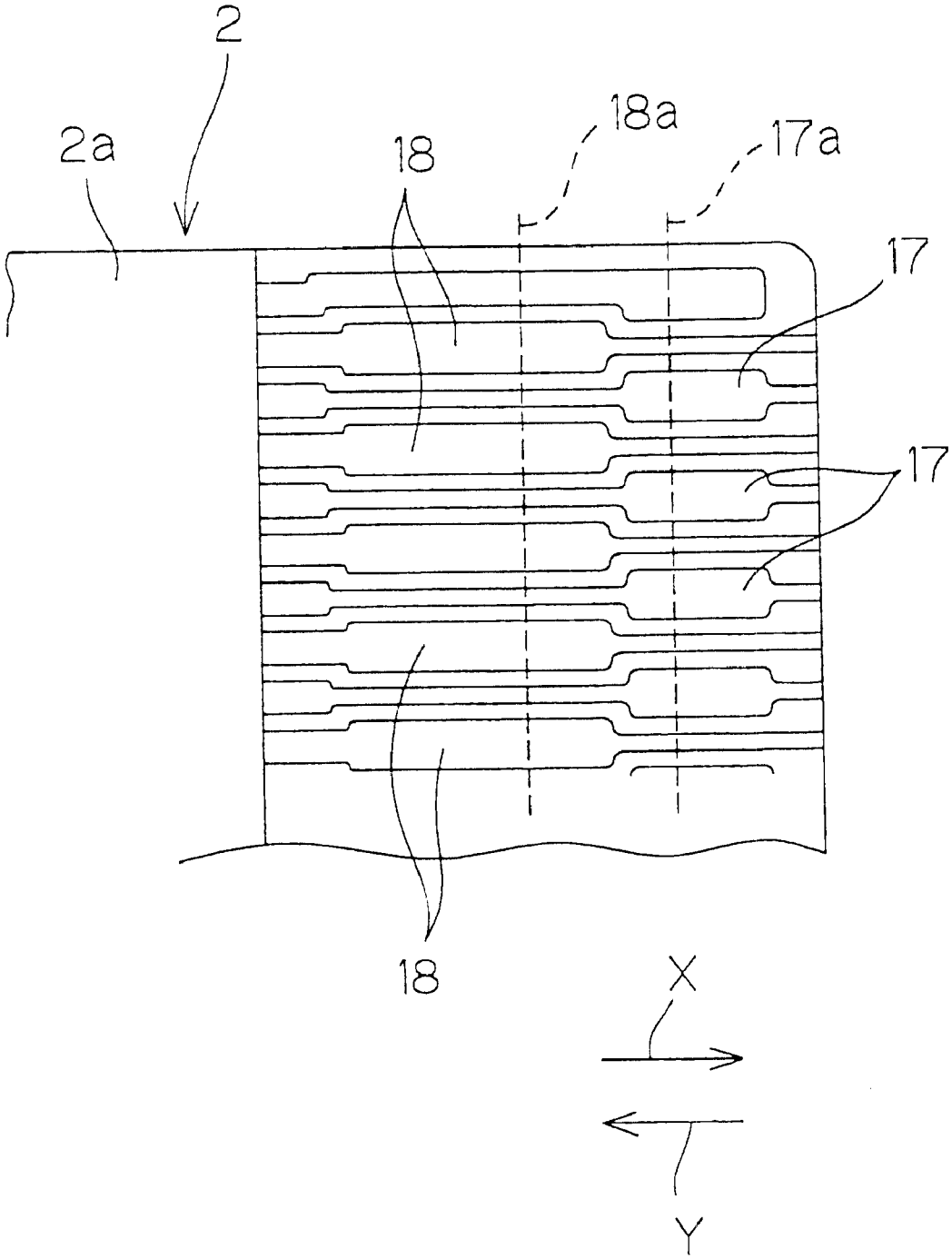
FIG. 8 is a plan view showing an upper surface of an FPC end portion.

As shown in FIG. 8, a plurality of first and second conductive connection portions 17, 18 defined by a printed circuit pattern are exposed from an end of an upper surface 2*a* of the FPC 2. The first and second conductive connection portions 17, 18 are arranged in two rows in a zigzag fashion, respectively connected with first and second contacts 22, 23 of the connector 1. Indicated at 17*a*, 18*a* are lines along which respective contact pressures between the first and second conductive connection portions 17, 18 and their corresponding contacts 22, 23 are established.

Figure 7:
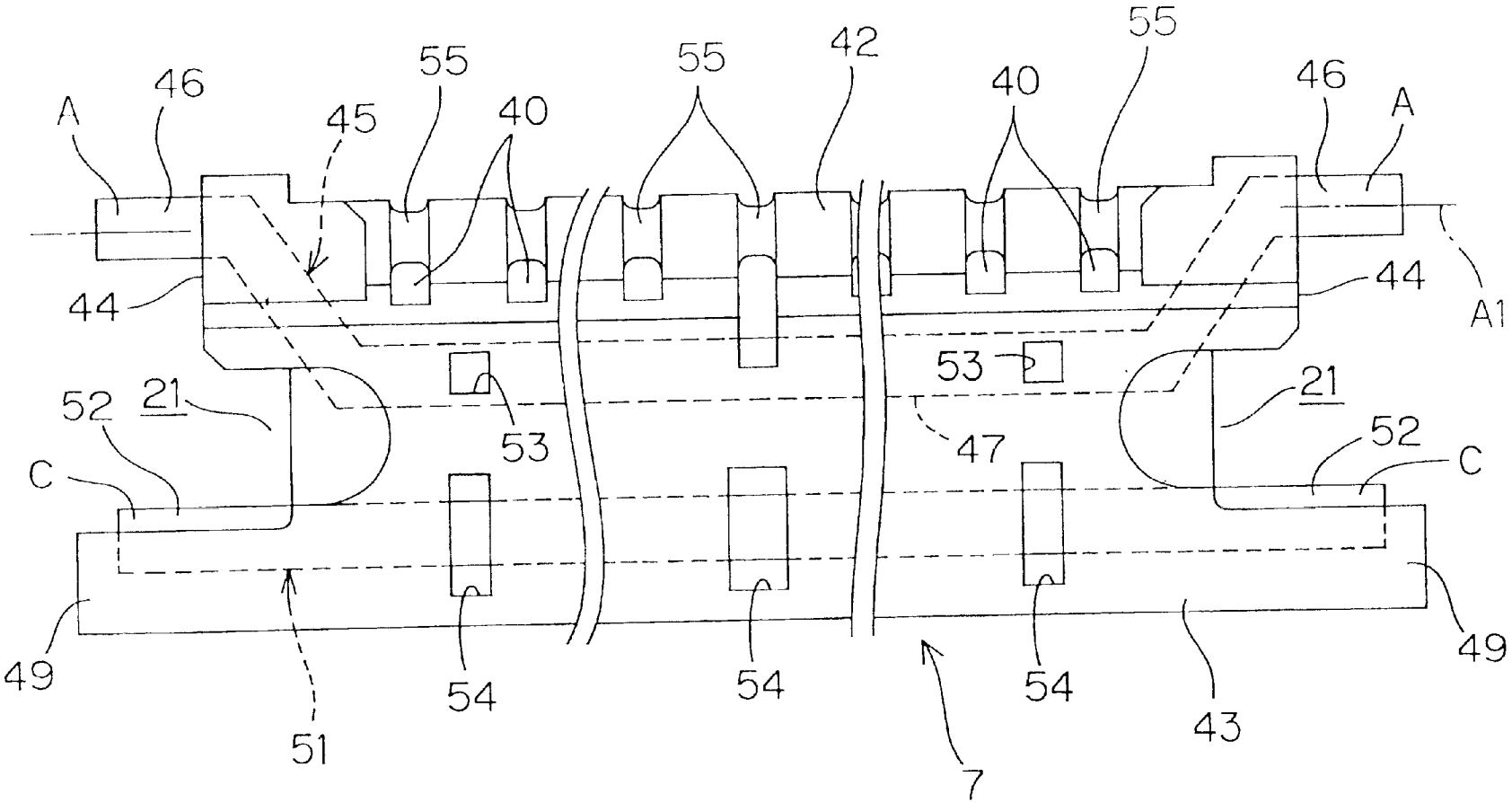
FIG. 7 is a partially cut-away plan view of a cover.

Pivot shafts A are exposed from opposite ends of the cover 7, respectively. As seen in FIG. 7, the pivot shafts A are defined by opposite ends of a metallic wire 45 embedded in the cover 7. Indicated at 51 is a metallic reinforcement wire which is also embedded in the cover 7. The wire 51 includes projections C at opposite ends thereof which are retained by a molding die during a molding process of the cover 7. Indicated at 53, 54 are apertures for partially exposing the wires 45, 51 to the outside of the cover 7, respectively.

Opposite side plates 8, 9 of the housing 4 define lateral sides of the insertion space 3. Fixing holes 11 (shown in FIGS. 2 and 3 but not in FIG. 1) open into respective front side surfaces of the side plates 8, 9 for fixingly receiving reinforcement tabs 10 from front. The reinforcement tabs 10 are formed of metal plates for supporting a pair of pivot shafts A projecting laterally outwardly of the cover 7.

Figure 3:
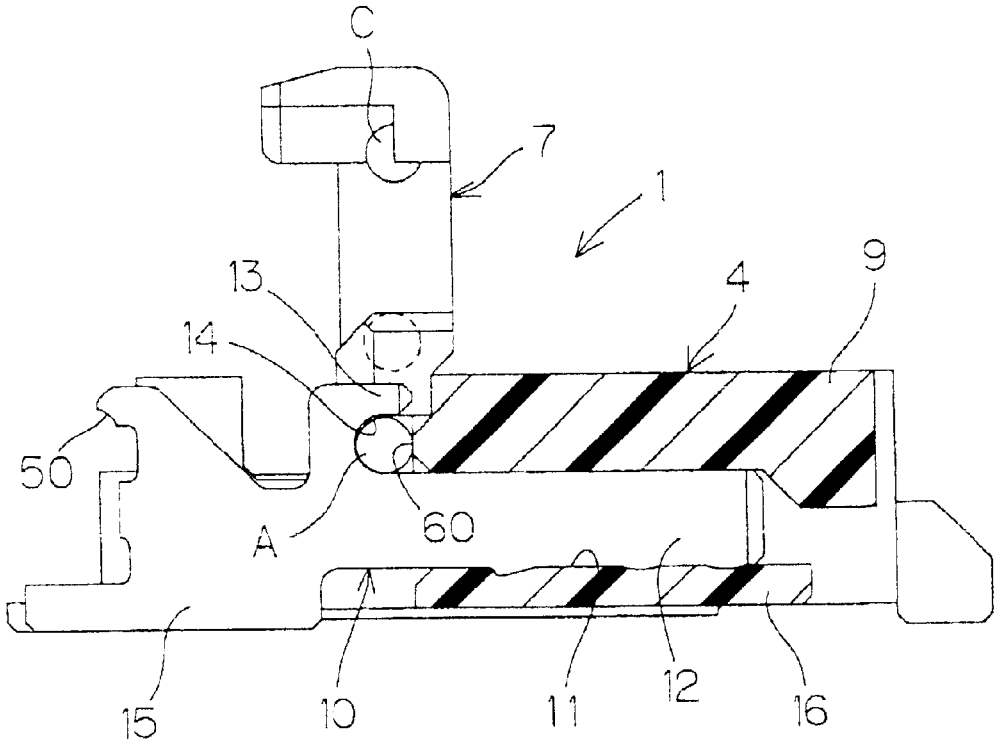
FIG. 3 is a sectional view taken on the line III—III in FIG. 2 for showing the connector with its cover opened, where hatch lines representing a section of a reinforcement tab are omitted.

Now referring to FIG. 3, the reinforcement tab 10 comprises a main body 12, a pivotal support portion 14 and a hook-shaped fixing portion 15. The main body 12 is inserted into the fixing hole 11 from front so as to be fixed to place via a locking projection. The pivotal support portion 14 is comprised of a U-shaped notch defined by an extension piece 13 extending upward from a front end of the main body 12, and pivotally supports the pivot shaft A. The fixing portion 15 extends downward from the front end of the main body 12 to be soldered to a substrate surface. The main body 12 is formed with a lock notch 50 at its front edge. The lock notches 50 serve to lock the cover 7 in the close position through engagement with the projection C defined by the opposite ends of the wire 51. As received by the U-shaped notch as the pivotal support portion 14, the pivot shaft A is retained in the U-shaped notch by an abutting portion 60 of the housing 4 pressed against the pivot shaft A.

Returning to FIGS. 1 and 2, guide walls 19, 20 upstand from opposite side edges of a front portion of a bottom plate 16 of the housing 4. When the cover 7 is closed, the guide walls 19, 20 are received by corresponding U-shaped gaps 21 defined at side edges of the cover 7, thereby restricting the lateral movement of the cover 7. Within the insertion space 3 of the housing 4, a plurality of first and second fork-shaped contacts 22, 23 are alternately arranged in two rows in a zigzag fashion across the housing 4.

Figure 4:
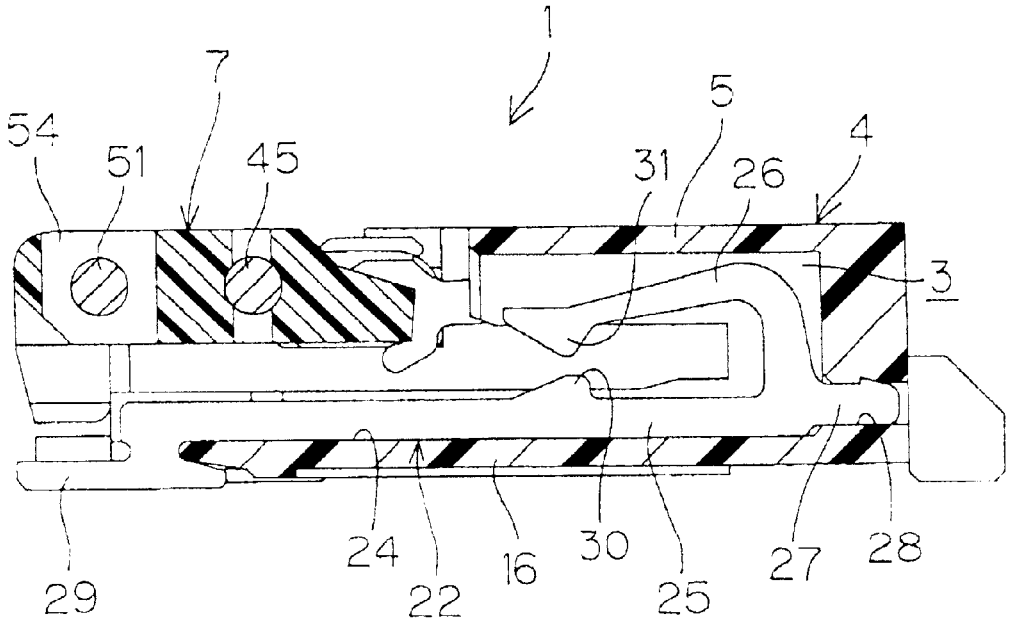
FIG. 4 is a sectional view taken on the line IV—IV in FIG. 2, where hatch lines representing a section of a first contact are omitted.

Referring to FIGS. 1, 2 and 4, the first contact 22 is comprised of a metallic member and fixedly inserted in the insertion space 3 of the housing 4 from front. Referring to FIG. 4, the first contact 22 comprises a fixing piece 25 inserted, from front, into a receiving groove 24 defined in an upper surface of the bottom plate 16 of the housing 4, and a resilient piece 26 located in a rear half portion of the insertion space 3 at place above the fixing piece 25.

A locking piece 27 with a locking projection extends rearwardly from an interconnection between the fixing piece 25 and the resilient piece 26. The locking piece 27 is inserted in a fixing hole 28 of the housing 4 so as to be fixed to place. The fixing piece 25 is provided with a lead portion 29 of an inverted T-shape at its front end. The lead portion 29 is soldered to the substrate surface on which the inventive connector 1 is mounted, while engaging a front edge of the bottom plate 16 of the housing 4 for preventing the upward dislocation of the fixing piece 25. Chevron-shaped projections 30, 31 are formed at the fixing piece 25 and the resilient piece 26 in opposed relation, respectively, for clamping the inserted FPC 2 therebetween thereby to ensure a contact pressure on the FPC 2.

Referring to FIGS. 1 and 7, the cover 7 is of a substantially rectangular plate, having a first and a second edges 42, 43 in opposed relation. The aforesaid pair of pivot shafts A project from laterally opposite ends 44, 44 of the first edge 42, respectively. The pivot shaft pair A are comprised of exposed opposite ends 46, 46 of the metallic wire 45 which is embedded in the cover during the molding thereof. The whole body of the wire 45 takes the form of a crank, an intermediate portion 47 of which extends parallel to the first edge 42 as spaced a distance therefrom.

Figure 9A:
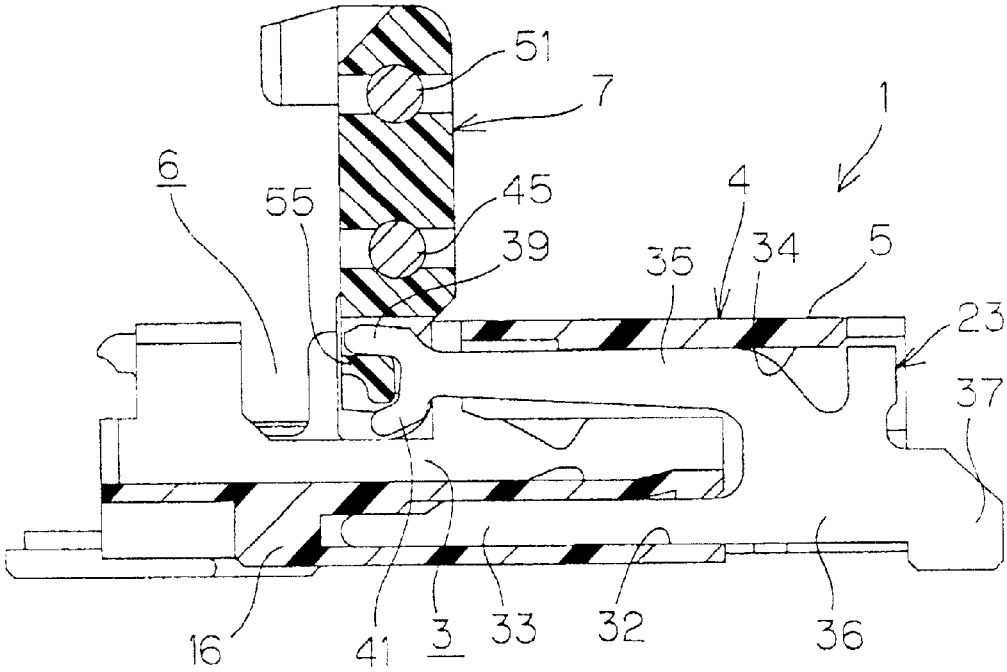
FIG. 9A is a sectional view corresponding to FIG. 5A for showing the connector with its cover opened.
Figure 9B:
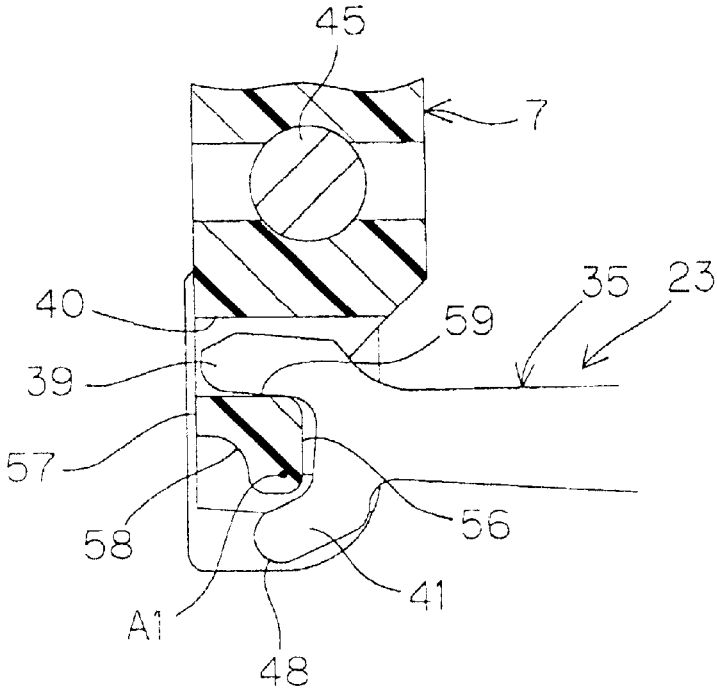
FIG. 9B is an enlarged view of a principal portion thereof, where hatch lines representing the section of the second contact are omitted.

As shown in FIGS. 9A and 9B, the first edge 42 of the cover 7 is formed with a plurality of through holes 40 transversely arranged for allowing ingress or egress of individual upper branches 39 of resilient pieces 35 of the second contacts 23 which will be described hereinafter. In FIG. 7, a portion between the first edge 42 and the through hole 40 and closer to the first edge 42 than the through hole 40 defines a regulating portion 55 for restricting a movable range of the resilient piece 35. Each of the projection pair C projects from a respective one of laterally opposite ends 49, 49 of the second edge 43 of the cover 7.

The pair of projections C are comprised of exposed opposite ends 52, 52 of the straight metallic reinforcement wire 51. The reinforcement wire 51 is embedded in the cover 7 during the molding process thereof and extended parallel to the second edge 43 as spaced a distance therefrom. The projection C exposedly extends downwardly and rearwardly from the lateral end 49 of the second edge 43.

Referring to FIG. 7, the wire 45 is exposed via one or more apertures 53 whereas an intermediate portion of the wire 51 is exposed via one or more apertures 54. These apertures 53, 54 play the following role. In order to insert the metallic wires 45, 51 in an article being molded to give the cover 7 with the wires embedded therein, the metallic wires 45, 51 must be supported in a given position within a molding die. The apertures 53, 54 permit wide support pins (insert pins) to be placed in the molding die at places in correspondence thereto. Thus, the wires 45, 51 may be stably supported within the molding die. As a result, the molded article has high positional accuracies for the pivot shafts A and projections C which are comprised of the opposite ends of the wires 45, 51.

Figure 5A:
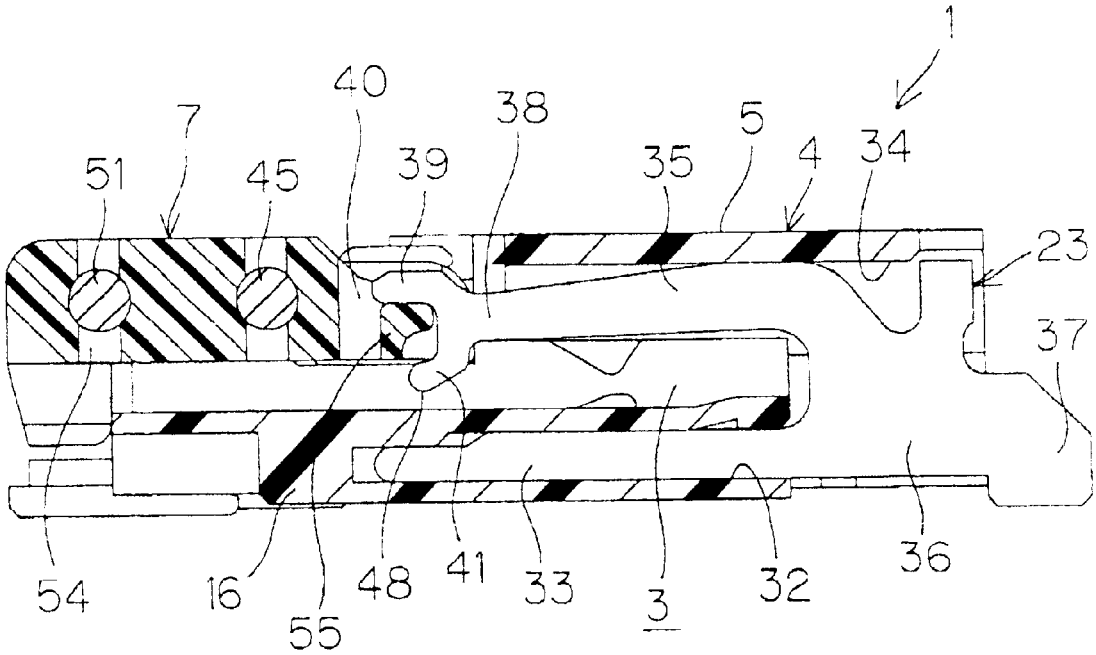

Referring to FIGS. 1, 2 and 5A, the second contact 23 is comprised of a metallic member which is inserted into the insertion space 3 of the housing 4 from rear side and fixed to place. Referring to FIG. 5A, the second contact 23 comprises a fixing piece 33, the resilient piece 35, a main body 36 and a lead portion 37. The fixing piece 33 has a locking projection and is fixedly inserted, from rear, into a fixing hole 32 at a lower part of the housing 4. The resilient piece 35 is inserted, from rear, into a receiving groove 34 defined in a lower surface of a top plate 5 of the housing 4 and is located above the fixing piece 33. The main body 36 interconnects rear ends of the fixing piece 33 and the resilient piece 35. The lead portion 37 extends diagonally rearward from the main body 36 to be soldered to the substrate surface.

Respective front ends of the fixing piece 33 and the resilient piece 35 reach a midportion of the housing 4 with respect to a front-to-rear direction thereof. A front end 38, or a free end of the resilient piece 35, is substantially branched into a U-shape, thus including an upper branch 39 and a lower branch 41. The upper branch 39 provides a first branch whereas the lower branch 41 provides a second branch. The lower branch 41 includes a contact point 48 pressed into contact with the second conductive connection portion 18 of FPC 2.

On the other hand, the first edge 42 of the cover 7 includes the regulating portion 55 which is located between the respective upper branches 39 and lower branches 41 of the resilient pieces 35 thereby restricting the range of displacement of the resilient pieces 35. Each regulating portion 55 is shaped like a hook in section. Adjoining each regulating portion 55 is the through hole 40 allowing the ingress or egress of the upper branch 39 in conjunction with the closing or opening of the cover 7.

Figure 5B:
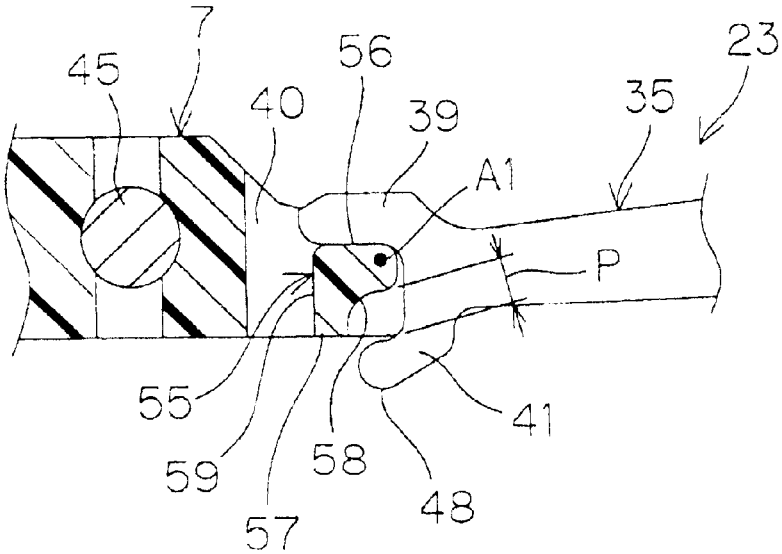
FIG. 5B is an enlarged view of a principal portion, where hatch lines representing a section of a second contact are omitted.
Figure 6:
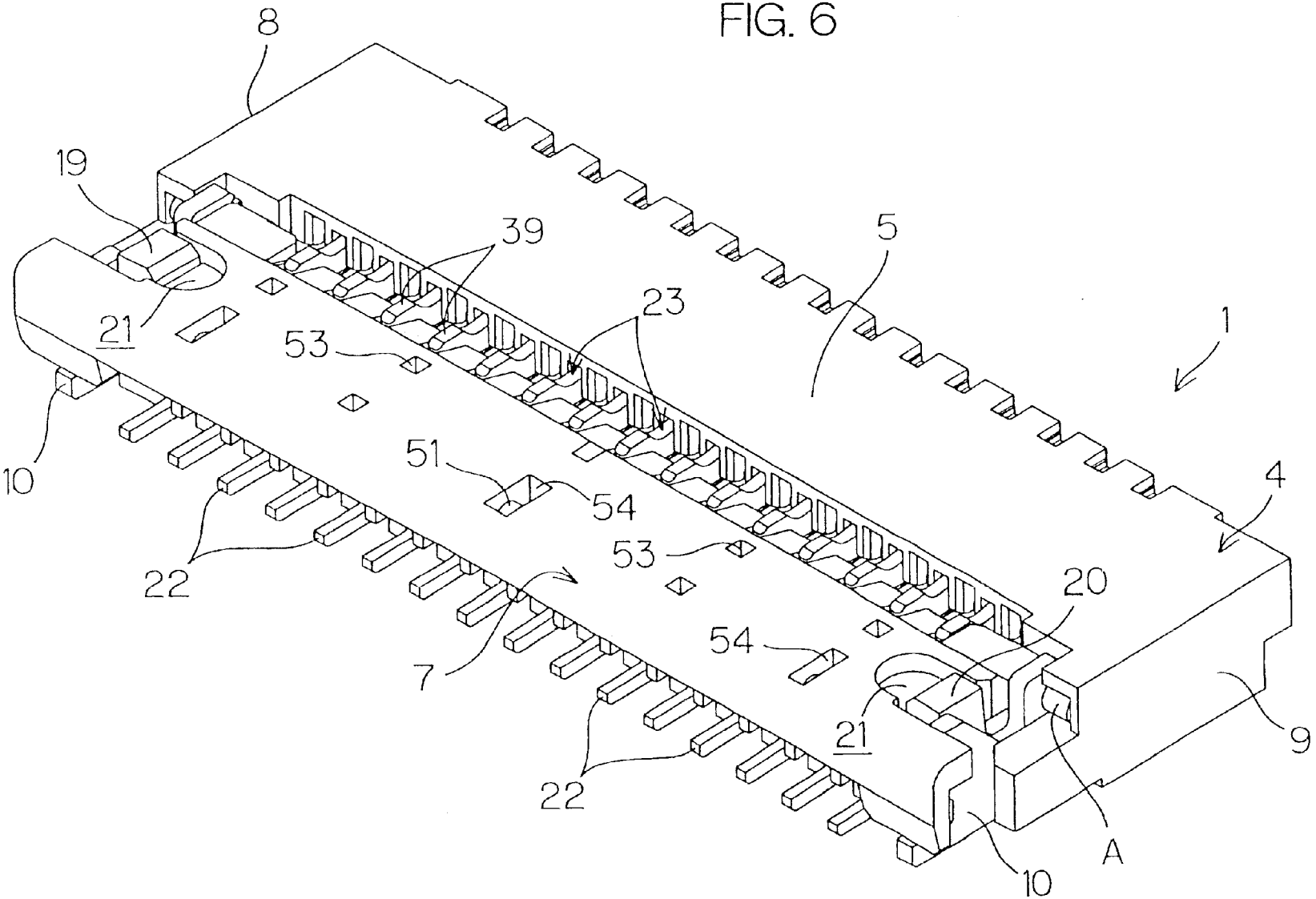
FIG. 6 is a perspective view showing the connector with its cover closed.

Referring to FIG. 5B, the regulating portion 55 includes a bearing surface 56 for bearing the upper branch 39 of the resilient piece 35, the upper branch being in a free state when the cover 7 is closed without the FPC 2 inserted. A recess 58 is formed in a surface 57 opposite to the bearing surface 56. The recess 58 serves to restrict an upward displacement of the lower branch 41 within a predetermined range P when the cover 7 is closed. Indicated at A1 is the pivotal axis as the center of the pivot shaft A. The pivotal axis A1 is positioned between the upper branch 39 and the lower branch 41 as extending through the regulating portion 55. The contact point 48 of the lower branch 41 is designed to position directly under the pivotal axis A1.

The regulating portion 55 further includes a cam surface. A cam surface 59 adjoins the bearing surface 56, while defining a part of an inside wall of the through hole 40. As shown in FIGS. 9A and 9B, the cam surface 59 acts to push up the upper branch 39 when the cover 7 is opened, thereby expanding the insertion space 3 for FPC located under the lower branch 41.

Figure 10A:
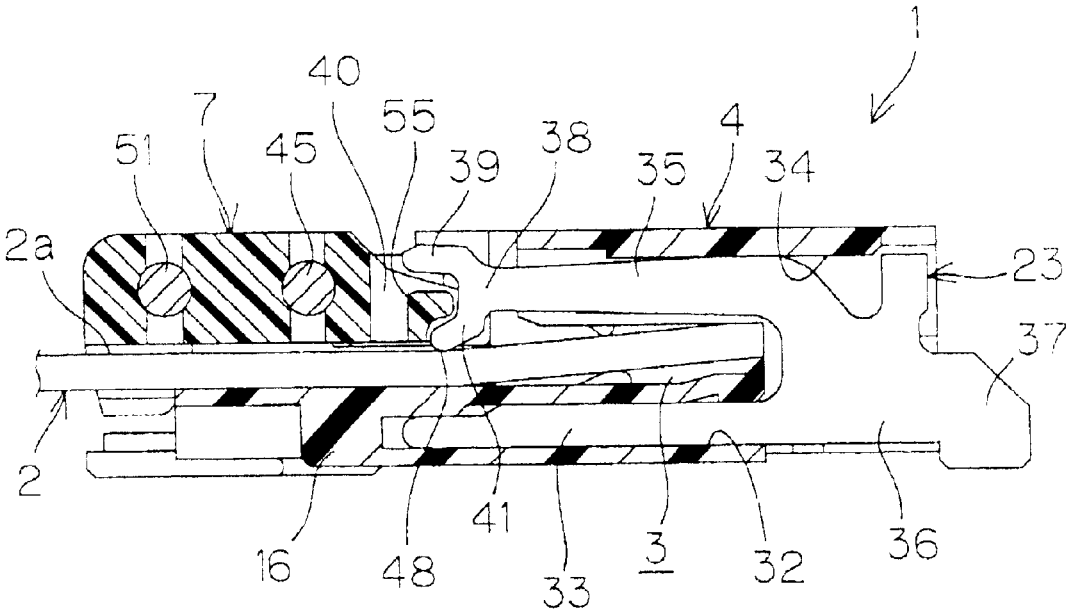
FIGS. 10 and 10B are sectional views corresponding to FIG. 5A for showing the connector connected with the FPC, where hatch lines representing the section of the second contact are omitted.
Figure 10B:
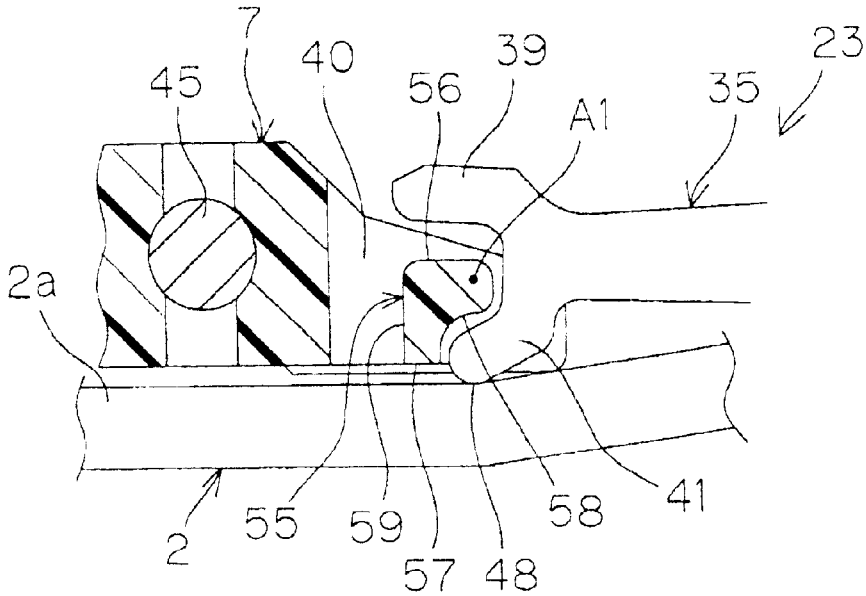

FIGS. 10A and 10B show a state in which the cover 7 is closed with the FPC 2 inserted in the insertion space 3. The FPC 2 is clamped between the bottom plate 16 of the housing 4 and the contact point 48 of the lower branch 41 of the second contact 23. As seen in FIG. 10B, the lower branch 41 along with the upper branch 39 are lifted up by a reaction force derived from the lower branch contacting via the contact point 48, while the lower branch 41 enters the recess 58 of the regulating portion 55. In this state, a gap is produced between the upper branch 39 and the bearing surface 56 whereas a gap is produced between the lower branch 41 and the recess 58.

Should the front end of the resilient piece 35 be pressed downward by some external force, the upper branch 39 bears against the bearing surface 56, thereby preventing any further deformation of the resilient piece. On the other hand, should the front end of the resilient piece 35 be lifted up by some external force, the lower branch 41 abuts against the recess 58, thereby preventing any further deformation of the resilient piece.

According to the embodiment, the range of displacement of the resilient piece 35 can be restricted in both the upward and downward directions by the regulating portion 55 of the cover 7 interposed between the upper branch 39 and the lower branch 41. Thus, an excessive deformation of the second contact 23 can be prevented. As a result, the connector of upper contact point type is capable of constantly achieving a high contact pressure on the FPC 2. In addition, the embodiment is adapted to prevent damage on the second contact 23 or FPC 2 caused by the excessive deformation of the second contact 23.

According to the embodiment, the first and second conductive connection portions 17, 18 of the FPC 2 are arranged in a zigzag pattern, as shown in FIG. 8, so that the first conductive connection portions 17 are located ahead of the second conductive connection portions 18 with respect to an insertion direction X of the FPC 2. Accordingly, the second fork-shaped contacts 23 corresponding to the conductive connection portions 18 located on the rear side with respect to the insertion direction X are located ahead of the first fork-shaped contacts 22 with respect to a removal direction Y of the FPC 2. As a result, the resilient piece 35 of the second contact 23 has a longer span, thus being more susceptible to deformation by the external force. However, the embodiment is particularly effective in that the range of displacement of the free end 38 of the resilient piece 35 is directly restricted by the regulating portion 55 interposed between the upper branch 39 and the lower branch 41.

When the cover 7 is closed, the resilient piece 35 must present such a resilience as to be pressed into contact with the FPC 2. Considering the dimensional tolerances of individual parts, it is desirable to define the greatest possible wide range for movement of the resilient piece 35. Therefore, it is preferred that the first edge 42 of the cover 7 has the minimum possible thickness. However, the first edge 42 of the cover 7 is required of a given thickness in order to ensure a predetermined strength thereof. In view of the foregoing, the embodiment provides the recess 58 in the first edge 42 of the cover 7 for allowing the ingress of the lower branch 41 thereinto when the cover 7 is closed, thereby offering the following merit. That is, a connector of an ultra thin design having a height of about 1.0 mm, for example, is capable of ensuring the strength of the first edge 42 of the cover 7 as well as providing the free end 38 of the resilient piece 35 with a sufficient movable range of about 0.15 to 0.2 mm, for example, for achieving a sufficient contact pressure. Incidentally, even the connector of the thin design conventionally has a height of 2.0 to 3.0 mm.

Since the pivot shaft A of the cover 7 is formed of a metal, the cover is less likely to break. The cover 7 is also prevented from bending by the metallic wire 45 embedded along the overall widthwise length (transverse direction) of the cover 7. This ensures a sufficient contact pressure between the FPC 2 and the contact point 48 of the resilient piece 35 of the second contact 23 and also prevents the cover 7 from disengaging from the housing 4. Since the wire 45 is inserted into the cover 7 at the time of resin molding thereof, a high adhesion between the wire 45 and the cover 7 is achieved, resulting in a more positive prevention of the deformation of the cover 7.

In addition to the wire 45, the reinforcement wire 51 is further provided for reinforcing the cover 7, so that the bending of the cover 7 is more positively prevented. Particularly, the pair of metallic reinforcement tabs 10, 10, the wire 45 and the reinforcement wire 51 substantially define a rectangle when the cove 7 is closed. Thus, the cover 7 is reliably fixed so that the connector 1 has a notably increased strength. As a result, the connector is assuredly able to apply the contact pressure on the FPC 2.

If the wire 45 was extended straight through the first edge 42, the first edge 42 would contain therein the wire 45 to be increased in the overall thickness thereof. Hence, the regulating portion 55 at the first edge 42 would also be increased in thickness so that the second contact 23 has an increased gap between the upper and lower branches 39, 41 of the resilient piece 35 thereof. This would result in an increased height of the connector 1. According to the embodiment hereof, the intermediate portion 47 of the wire 45 takes the form of a channel such that the wire 45 is spaced a distance away from the first edge 42 of the cover 7 where the regulating portion 55 is disposed. Therefore, as shown in FIG. 5B, the regulating portion 55 is decreased in thickness, permitting the implementation of the thin design of the connector 1. This is also effective to prevent a short circuit between the second contact 23 and the wire 45.

It is to be noted that the present invention is not limited to the foregoing embodiment. For instance, the connector of the foregoing embodiment may be mounted in a manner that top-bottom positions of the connector are oriented in a different direction from that illustrated by the embodiment.

Further, the first contact may be configured the same way as the second contact. Alternatively, the connector may dispense with the first contact, thus solely including the second contact.

Furthermore, the pair of projections C may be constructed from a resin material integrally with the cover 7. On the other hand, the wire 51 for reinforcement purpose may be dispensed with so that the cover 7 is reinforced by a single wire 45 alone. Other various changes and modifications may be made within the scope of the invention.

What is claimed is:

1. An electrical connector for a flexible printed board comprising:

a synthetic-resin housing having an opening, a plurality of fork-shaped contacts being arranged to face into the opening, each of the contacts having a resilient piece and a fixing piece in opposed relation, an insertion space for the flexible printed board defined between the resilient piece and the fixing piece, and a synthetic-resin cover being rotatable around a predetermined pivotal axis to open or close the opening, wherein each fork-shaped contact includes a U-shaped portion including a first branch and a second branch branched from a free end of the resilient piece, wherein the second branch adjoins the insertion space;

wherein the second branch includes a contact point pressed into contact with the flexible printed board inserted in the insertion space, and wherein one edge of the cover includes a regulating portion interposed between the first and the second branches for bidirectionally restricting a range of displacement of the free end of the resilient piece.

2. The electrical connector for flexible printed board as claimed in claim 1, wherein the regulating portion includes a cam surface for pushing the first branch into displacement with the opening of the cover so as to expand the insertion space in conjunction.

3. The electrical connector for flexible printed board as claimed in claim 2, wherein the cam surface moves away from the first branch in conjunction with the closing of the cover.

4. The electrical connector for flexible printed board as claimed in claim 2, wherein the cover includes a through hole allowing the ingress or egress of the first branch thereinto or therefrom when the cover is closed or opened, a part of the through hole being defined by the cam surface.

5. The electrical connector for flexible printed board as claimed in claim 1, wherein the regulating portion includes a recess for restricting the displacement of the second branch within a predetermined range as allowing the ingress of the second branch thereinto, when the cover is closed with a flexible printed board inserted in place.

6. The electrical connector for flexible printed board as claimed in claim 1, wherein the regulating portion includes a bearing surface for bearing the first branch when the cover is closed without a flexible printed board inserted in place.

7. The electrical connector for flexible printed board as claimed in claim 6, wherein a recess is formed in an opposite surface to the bearing surface.

8. The electrical connector for flexible printed board as claimed in claim 6, wherein the bearing surface and a cam surface adjoins each other.

9. The electrical connector for flexible printed board as claimed in claim 1, wherein the predetermined pivotal axis extends through the regulating portion.

10. The electrical connector for flexible printed board as claimed in claim 1, wherein the cover includes a metallic wire partially embedded therein during molding thereof, and wherein a pair of pivot shafts along the predetermined pivotal axis are provided at a pair of opposite ends of the wire.

11. The electrical connector for flexible printed board as claimed in claim 10, wherein the wire includes an intermediate portion between the pair of opposite ends thereof, the intermediate portion being substantially shaped like a channel.

12. The electrical connector for flexible printed board as claimed in claim 1, wherein the contact point of the fork-shaped contact having the first and the second branches is located ahead of a contact point of the other fork-shaped contact with respect to an insertion direction of a flexible printed board.

* * * * *